US005630738A

United States Patent [19]

Ito et al.

[11] Patent Number: 5,630,738

[45] Date of Patent: May 20, 1997

[54] FEMALE TERMINAL, METAL FIXTURE

[75] Inventors: Tomonari Ito; Masaaki Kobayashi, both of Yokkaichi, Japan

[73] Assignee: Sumitomo Wiring Systems, Ltd., Japan

[21] Appl. No.: 495,184

[22] Filed: Jun. 27, 1995

[30] Foreign Application Priority Data

Jul. 21, 1994 [JP] Japan ..... 6-191938
Jul. 29, 1994 [JP] Japan ..... 6-197964

[51] Int. Cl.[6] ..... H01R 11/22

[52] U.S. Cl. ..... 439/852; 439/851

[58] Field of Search ..... 439/850, 851, 439/852

[56] References Cited

U.S. PATENT DOCUMENTS 4,560,231 12/1985 Shirai .
5,443,592 8/1995 Ittah et al. ..... 439/852
5,480,320 1/1996 Saimoto ..... 439/852

FOREIGN PATENT DOCUMENTS 0263610 4/1988 European Pat. Off. .
5862564 4/1981 Japan .

*Primary Examiner*—David L. Pirlot
*Assistant Examiner*—Tho Dac Ta
*Attorney, Agent, or Firm*—Jordan B. Bierman; Bierman, Muserlian and Lucas LLP

[57] ABSTRACT

A female terminal metal fixture which can prevent a resilient contact tongue from being deflected over a wide range. A box-like body is provided on its right and left side walls with an inwardly bulged restrictive portion formed by a bulging process. Each restrictive portion extends longitudinally below a resilient contact tongue from the distal end of the tongue to the front end of the contact. When a tab is inserted into the insertion space slantwise, the tongue is deflected down by a distance greater than lo that in the case of a normal insertion. The first contact section of the tongue contacts the front corner of the restrictive portion, while the second contact section contacts the rear upper face of the portion. Thus, the tongue is prevented from being deflected beyond its elastic limit. Alternatively, the box-like body is provided on its side walls with an inwardly bulged restrictive portion extending longitudinally from an opening in the body to about the midpoint of the resilient tongue. The restrictive portion has an upper horizontal edge section at its rear, and an upper ascending slope edge section at its front. When the tab is inserted into the opening slanting downwardly, the distal end contacts the ascending slope and is prevented from reaching the tongue by the edge section. If the tab is further inserted into the opening, the distal end slides on the upper ascending slope and reaches the upper horizontal edge. Then, the tab slides on the horizontal edge and is directed to the correct horizontal position in the insertion space. This keeps deflection of the tongue within the elastic limit thereof and provides an elastic contact between the tab and the tongue.

11 Claims, 11 Drawing Sheets

FEMALE TERMINAL, METAL FIXTURE

BACKGROUND OF THE INVENTION (1) Field of the Invention

This invention relates to a female terminal metal fixture which is provided in a box-like body with a resilient contact tongue adapted to elastically contact with a tab of a male terminal metal fixture and in particular functions to prevent the resilient contact tongue from being excessively deflected.

(2) Statement of the Prior Art

A typical example of conventional female terminal metal fixtures which function to prevent a resilient contact tongue from being excessively deflected is disclosed in Japanese Utility Model Public Disclosure No. HEI 3-77382 (1991). For convenience of explanation, the conventional female terminal metal fixture disclosed in the above Disclosure will be described below by referring to FIGS. 19 to 21. FIG. 19 is a longitudinal sectional view of a conventional female terminal metal fixture. FIG. 20 is a longitudinal sectional view similar to FIG. 19, illustrating a position in which a tab is correctly inserted into a box-like body. FIG. 21 is a longitudinal sectional view similar to FIG. 19, illustrating a position in which the tab is incorrectly inserted into the box-like body.

As shown in FIG. 19, a box-like body 31 is provided on each side wall 32 with a projection 33, which is disposed below a distal end side of a resilient contact tongue 34 turned back rearwardly from a front end of a bottom wall, by punching up the side wall 32 inwardly in the body 31. When a tab 35 of a mating male terminal metal fixture is inserted into the body 31 from its front end, the tab 35 is inserted into an insertion space 38 defined in the body 31 between the resilient contact tongue 34 and a ceiling wall 36, as shown in FIG. 20, while deflecting the resilient contact tongue 34 downwardly so that the tongue 34 does not contact with the projection 33, if an insertion direction is correct. However, if an insertion angle is not so great, the resilient contact tongue 34 is borne by the projection 33 before the deflection of the tongue 34 exceeds its elastic limit, thereby preventing a further deflection of the tongue 34 in a downward direction. That is, it is possible to prevent the resilient contact tongue 34 from being extremely deflected and from reaching a plastic deformation.

However, if the insertion angle of the tab 35 becomes great, the distal end of the tab 35 abuts on the resilient contact tongue 34 at a position between a turn-back portion 37 and a contact point on the projection 33, for example, a position shown in FIG. 21. Since the tongue 34 is not borne at this position, the tongue 34 will be readily brought into plastic deformation when the tab 35 pushes down the tongue 34 strongly.

On the other hand, to overcome this problem, Japanese Patent Public Disclosure No. HEI 6-60931 (1994) discloses a female terminal metal fixture in which a horizontally extending projection is formed on each side wall of a box-like body by punching up the wall inwardly in the body. The projections can support a resilient contact tongue at its distal end side point and its middle point, thereby preventing the tongue from being extremely deflected. However, the box-like body will be weakened at its side walls since the side walls are punched up over a wide range.

Still another conventional female terminal metal fixture will be described below by referring to FIGS. 22 to 24, for convenience of explanation.

FIG. 22 is a longitudinal sectional view of still another conventional female terminal metal fixture. FIG. 23 is a longitudinal sectional view similar to FIG. 22, illustrating a position in which a tab is correctly inserted into a box-like body. FIG. 24 is a longitudinal sectional view similar to FIG. 22, illustrating a position in which the tab is incorrectly inserted into a box-like body.

The female terminal metal fixture, as shown in FIG. 22, includes a box-like body 31 and a resilient contact tongue 34 in the body 31, which is adapted to elastically contact with a tab 35 of a male terminal metal fixture. The resilient contact tongue 34 has a turn-back portion 37, which is formed by inwardly bending an elongated plate extending from a front end of a bottom wall 40 of the body 31 in a manner of a hair pin, and a curved portion 39, which is formed by outwardly bending a distal end of the tongue 34. The box-like body 31 encloses the resilient contact tongue 34.

When the tab 35 of the male terminal metal fixture is inserted through a front opening in the body 31 into an insertion space 38 defined between the resilient contact tongue 34 and a ceiling wall 36 of the body 31, the tab 35 contacts with the resilient contact tongue 34 elastically and electrically, as shown in FIG. 23. However, if the resilient contact tongue 34 is permitted to be freely deformed, insertion of a foreign substance causes the resilient contact tongue 34 to be deformed over an elastic limit. This results in poor connection between the male and female terminal metal fixtures. Heretofore, there have been several means for preventing excess deflection of the resilient contact tongue 34. For example, the curved portion 39 shown in FIG. 22 was provided.

However, any foreign substance becomes trapped in the insertion space 38, because the conventional means for preventing excess deformation are provided on the resilient contact tongue itself. There are some cases in which even the curved portion 39 cannot prevent excess deformation of the tongue 34.

For instance, in the case that dust such as metallic chips are attached to a top face of the tab 35 (such dust comprises a foreign substance), the tab is increased in thickness. When such a tab having increased thickness is inserted into the box-like body, the tab deforms the resilient contact tongue over its elastic limit. Also, any errors caused during producing processes will bring about an increased thickness over a standard thickness into the tab.

In the case that alignment of the fixtures comes out of a standard over unexpectedly, an insertion angle of the tab 35 to the female terminal metal fixture becomes greater as shown in FIG. 24 and the distal end of the tab 35 abuts near the turn-back portion 37 of the resilient contact tongue 34. Thus, it is impossible to avoid excess deformation of the tab because the tab is not borne at the abutting position.

SUMMARY OF THE INVENTION

An object of the present invention is to provide a female terminal metal fixture which can prevent excess deflection of a resilient contact tongue over a wide range on account of incorrect insertion of a tab of a male terminal metal fixture into an insertion space in a box-like body and does not lower the strength of the box-like body.

Another object of the present invention is to provide a female terminal metal fixture which can guide a tab of a male terminal metal fixture to a correct position to prevent excess deflection of a resilient contact tongue even if the tab is inserted into a box-like body in a slanting manner.

In order to achieve the above objects, a female terminal metal fixture of the present invention comprises: a box-like body; a resilient contact tongue bent back into an interior of the box-like body from a front end of the body, an insertion space being defined between the resilient contact tongue and walls of the box-like body in the interior so as to receive a tab of a male terminal metal fixture in a resilient contact manner; and an inwardly bulged restrictive portion formed on each of opposite side walls of the box-like body.

According to a first aspect of the present invention, the restrictive portion may be bulged inwardly from each side wall of the box-like body so that the restrictive portion contacts with the resilient contact tongue on at least two areas in the longitudinal direction when the tab of the male terminal metal fixture is inserted into the insertion space in the box-like body.

The restrictive portion may be formed continuously over a given length in the longitudinal direction in the insertion space in said box-like body, or may be formed discontinuously at two position in the longitudinal direction in the insertion space in the box-like body.

The resilient contact tongue may contact with the restrictive portion at the distal end in a substantial linear manner, or may contact with the restrictive portion at the distal end in a substantial linear manner.

The restrictive portion may be provided on either side wall of the box-like body.

According to the first aspect of the present invention, when the resilient contact tongue is excessively deflected, the tongue is borne on the restrictive portion at the front and rear areas in the longitudinal direction, whereby excess deflection of the tongue is avoided.

When the resilient contact tongue is supported by the restrictive portion at two areas thereon, at least one of the two areas extends longitudinally over a given length.

Since the resilient contact tongue is borne on the restrictive portion at two positions, it is possible to enlarge a range for preventing excess deflection of the tongue.

Further, since the respective portion is inwardly bulged on each side wall of the box-like body, the restrictive portion itself can reinforce the side wall.

In addition to the above effects, since a part of the resilient contact tongue is supported on the restrictive portion over a given range of length, the tongue can be borne thereon more stably and since a load is distributed over the range excess deflection of the tongue can be positively prevented.

According to a second aspect of the preset invention, the restrictive portion may be bulged inwardly from each side wall of the box-like body so that the restrictive portion prevents the tab of the male terminal fixture from approaching the resilient contact tongue over an allowable range.

The restrictive portion is formed near an inlet portion in the box-like body and wherein the restrictive portion is provided on the distal end with an ascent slope edge section which contacts with an end of the tab of the box-like body to guide the tab into the insertion space when the tab is inserted into the box-like body in a slanting direction. The restrictive portion may be formed by means of a bulging or punching process.

The restriction portion may be provided on either side wall of the box-like body.

According to the second aspect of the present invention, even if a foreign substance with a more than standard thickness is inserted into the opening in the box-like body, the foreign substance will be deflected from the insertion space by the respective portion, so as to be prevented from reaching the resilient contact tongue beyond the allowable range. That is, a foreign substance cannot enter into a standard depth in the insertion space, thereby avoiding the deflection of the resilient contact tongue over its elastic limit. If the tab is inserted into the box-like body in a slanting manner, the restrictive portion can limit insertion of the tab.

When the tab of the male terminal metal fixture is inclined and inserted into the box-like body, the distal end of the tab abuts on first and then slides on the ascent slope edge section. The tab is guided into the correct path while sliding along the ascent slope edge section and then the tab enters into the insertion space.

According to the second aspect of the present invention, even if any foreign substance with a thickness which is more than a standard tab thickness is inserted into the opening in the box-like body in a slant manner, it is possible to maintain the resilient contact tongue with a suitable spring characteristic since the entrance of the foreign substance into the insertion space is restricted. Consequently, an electrical communication can be positively obtained between the tab and the resilient contact tongue.

In the case that the tab of the male terminal metal fixture is inserted into the opening in the box-like body in an incorrect posture, the tab is naturally set to a correct insertion posture and led into the insertion space. This makes it possible to smoothly insert the male terminal metal fixture into the female terminal metal fixture.

DETAILED DESCRIPTION OF THE PREFERRED EMBODIMENTS

A first embodiment of a female terminal metal fixture in accordance with the present invention will be explained below by referring now to FIGS. 1 to 6.

Figure 1:
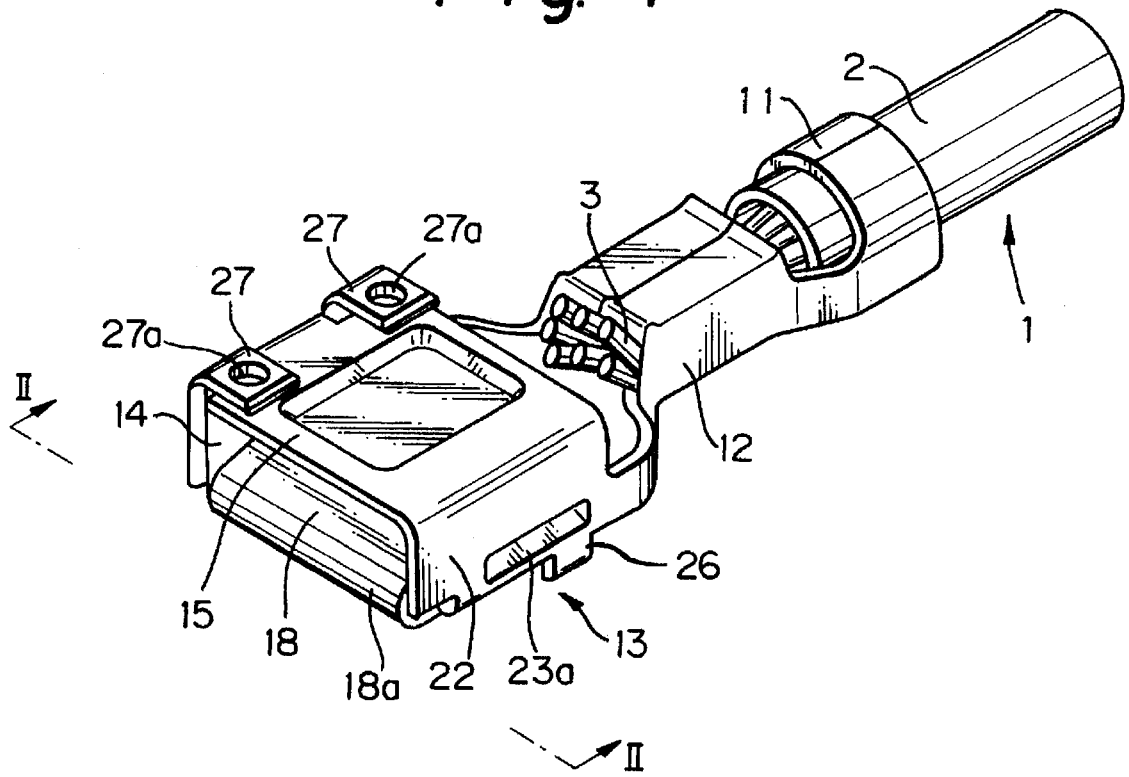
FIG. 1 is a perspective view of a first embodiment of a female terminal metal fixture of the present invention.
Figure 2:
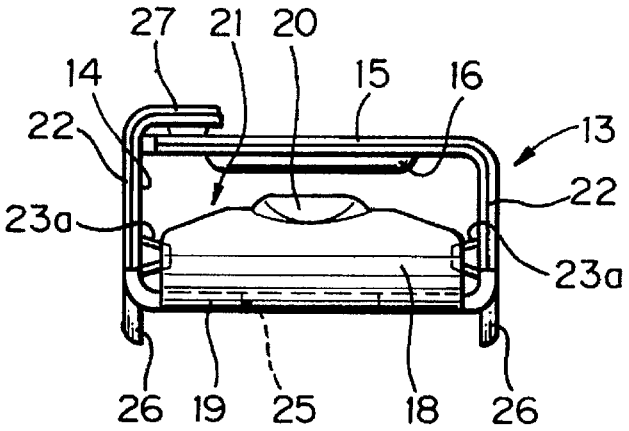
FIG. 2 is a front elevational view of the first embodiment taken along line II—II in FIG. 1.
Figure 3:
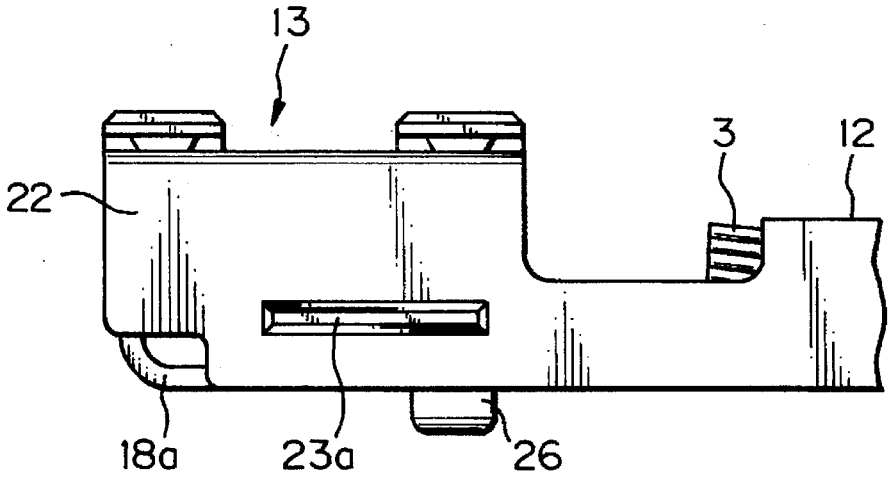
FIG. 3 is a side elevational view of the first embodiment shown in FIG. 1.

A female terminal metal fixture in this embodiment is formed by bending a thin metallic plate having a given shape and includes an insulation barrel 11 adapted to clamp an end of an insulation cover 2 of an electrical cable 1, a wire barrel 12 adapted to clamp an end of core wires 3 exposed from the cover 2, and a box-like body 13 connected to a front end of the wire barrel 12, as shown in FIG. 1.

Figure 4:
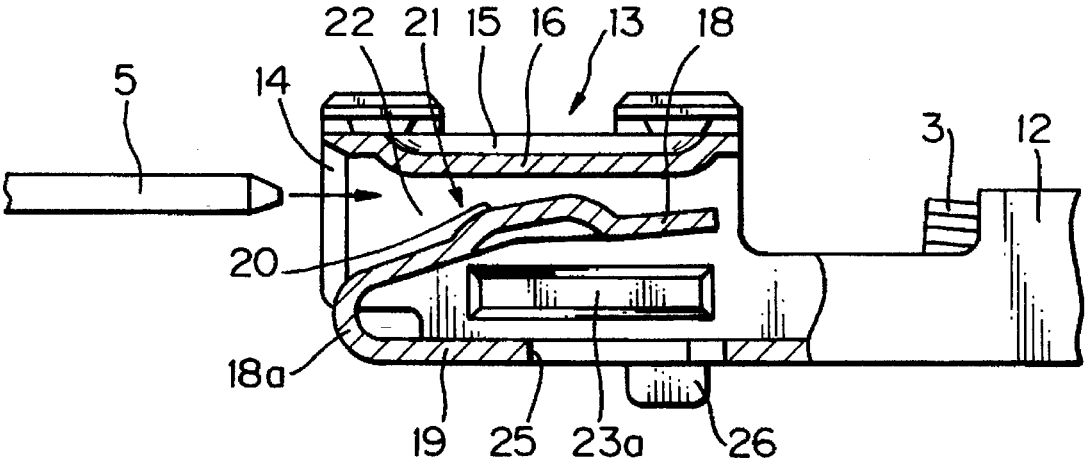
FIG. 4 is a longitudinal sectional view of the first embodiment shown in FIG. 3.

The box-like body 13 has a bottom wall 19, opposing side walls 22 and a ceiling wall 15, which are formed from the thin metallic plate by a bending process. The ceiling wall 15 extends from one of the side walls 22 and is pushed down at a free end thereof by a pair of keep pieces 27 which extend from the other side wall 22 and are provided on the center with bulged areas 27*a*. The engagement of the bulged areas 27*a* on the top face of the ceiling wall 15 maintains the box-like body 13 in a given shape. The box-like body 13 is provided in its front end with a front opening 14 through which a tab 5 of a male terminal metal fixture is inserted into an insertion space 21, as shown in FIG. 4. The ceiling wall 15 of the box-like body 13 is provided on the center with an inwardly bulged area 16.

The box like body 13 is provided in its interior with a resilient contact tongue 18. The resilient contact tongue extends from a front end of a bottom wall 19 in a developed state of a thin metallic plate and is folded in a substantial U-shaped before being the opposed side walls 22 of the body 13. A turn-back portion 18*a* of the resilient contact tongue 18 is disposed at a slightly inner portion behind front end edges of the side walls 22, so that the turn-back portion 18*a* is set so as not to directly contact with a front end wall in a cavity in a female connector housing not shown when the female terminal metal fixture is inserted into the cavity in the housing.

Figure 6:
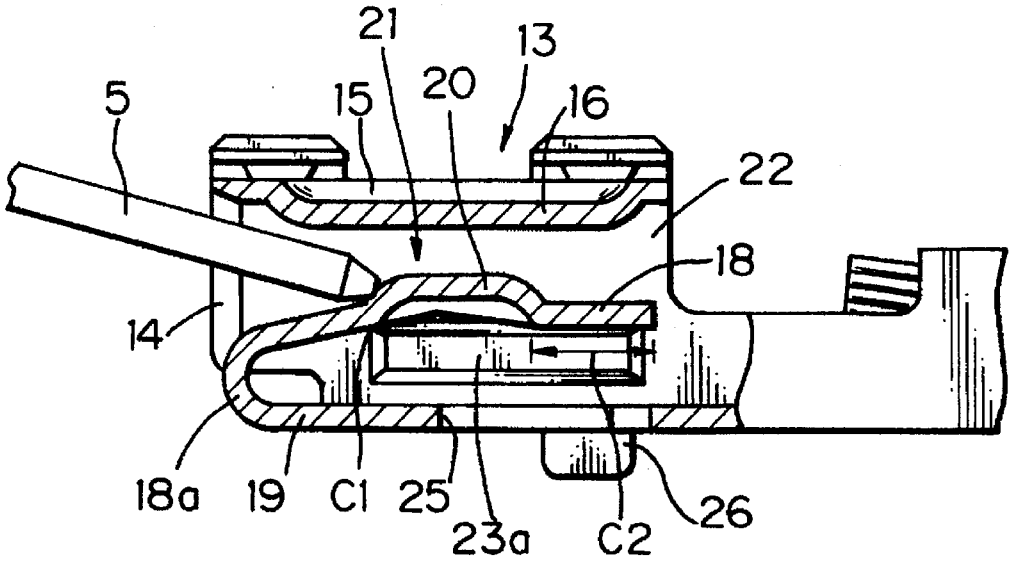
FIG. 6 is a longitudinal sectional view similar to FIG. 4, illustrating a position in which the tab is incorrectly inserted into the box-like body.

In this embodiment, the resilient contact tongue 18 is provided with an ascending slope toward its distal end and with a suitable elasticity. Further, the tongue 18 is provided on the center with an upwardly bulged contact surface 20. The contact surface 20 is flat at its top so that the tab 5 is elastically clamped between the flat top of the surface 20 and the inwardly bulged area 16 of the ceiling wall 15. The resilient contact tongue 18 does not engage with a restrictive portion 23*a* described hereinafter so long as the tab 5 is inserted into the insertion space 21 in a normal manner. However, if the tab 5 is inserted into the insertion space 21 in an abnormal manner (for example, in the case of a great insertion angle of the tab 5 as shown in FIG. 6), the tongue 18 is deflected so that a distal end side beyond the contact surface 20 engages with the restrictive portion 23*a* continuously along a longitudinal direction of the portion 23*a*.

The box-like body 13 is provided on the opposed side walls 22 with a pair of restrictive portions 23*a* mentioned above to prevent an excess deflection of the resilient contact tongue 18. The restrictive portion 23*a* is formed by bulging the side wall 22 inwardly. Particularly, the restrictive portion 23*a* is provided on its peripheral edge with a ramp face having an even width and on its center with a flat face parallel to the side wall 22.

A bulging height of the restrictive portion 23*a* is set to be so great that the resilient contact tongue 18 engages with the restrictive portion 23*a* at the lower opposing edges of the tongue 18 when the tongue 18 is elastically deflected by a certain distance. The restrictive portion 23*a* is disposed on the side wall 22 at a position below a natural state of the resilient contact tongue 18 and above an elastic limit state of the tongue 18. Further, the restrictive portion 23*a* extends horizontally from a position corresponding to a front end edge of the contact surface 20 on the tongue 18 to a position corresponding to the distal end of the tongue 18. Thus, in the case that the resilient contact tongue 18 engages with the restrictive portion 23*a*, as shown in FIG. 6, the front end edge of the contact surface 20 becomes a first contact area C1 and the length from the rear end edge of the contact surface 20 to the free end of the tongue 18 becomes a second contact area C2. As shown in FIG. 6, the second contact area C2 engages with the tongue 18 in a plane contact manner in the longitudinal direction.

The box-like body 13 is provided in its bottom wall 19 with an opening 25 which receives a lance provided in the cavity in the connector housing not shown which accommodates the female terminal metal fixture. A stabilizer 26 is provided on each side edge of the opening 25 so that the stabilizers 26 engage with slots in the cavity to eliminate plays between the cavity and the fixture.

An operation of the first embodiment will be explained below.

Figure 5:
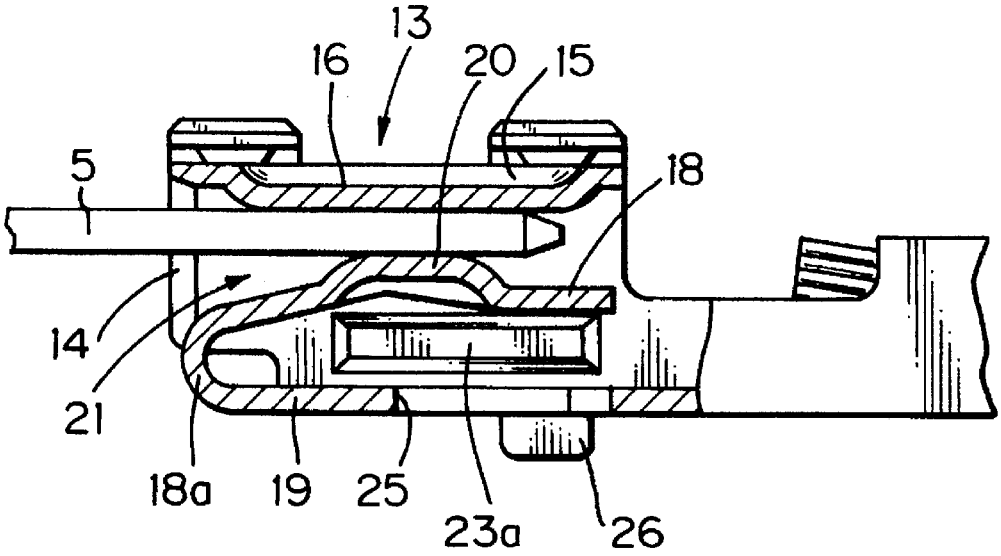
FIG. 5 is a longitudinal sectional view similar to FIG. 4, illustrating a position in which a tab is correctly inserted into a box-like body.

When the tab 5 of the male terminal metal fixture is inserted through the front opening 14 in the box-like body 13 into the insertion space 21 defined between the ceiling wall 15 of the body 13 and the resilient contact tongue 18, as shown in FIG. 5, the tab 5 first contacts with the contact surface 20 on the resilient contact tongue 18 and then pushes down the tongue 18 while passing over the contact surface 20. The resilient contact tongue 18 is elastically deflected to a position slightly above the restrictive portion 23*a*. The tab 5 is elastically clamped between the contact surface 20 on the tongue 18 and the inwardly bulged area 16 on the ceiling wall 15 by an elastic recovery force of the tongue 18, thereby electrically coupling the tab 5 and the tongue 18.

On the other hand, in the case that the tab 5 is inserted into the front opening 14 slant down on account of an alignment error (or an entrance of foreign substances), the tab 5 abuts on this side from the contact surface 20 and pushes down the tongue 18. The resilient contact tongue 18 is deflected more than in the case of the normal insertion of the tab 5, so that the first contact area C1 on the tongue 18 engages with a front corner of the restrictive portion 23*a* in a linear contact manner and the second contact area C2 on the tongue 18 engages with the inner part of the restrictive portion 23*a* in a plane contact manner. Consequently, the resilient contact tongue 18 is prevented from being deflected over its elastic limit.

In the case that any dust attaches on the tab 5 in spite of a correct insertion of the tab 5, the resilient contact tongue 18 is greatly deflected in a downward direction. In this case, the tongue 18 similarly engages with the restrictive portion 23*a* at the first and second contact areas C1 and C2, thereby preventing an excess deflection over the elastic limit.

According to the first embodiment of the present invention, since any external force applied to the resilient contact tongue is borne on two contact areas C1 and C2 by the restrictive portion 23*a*, the resilient contact tongue can resist any strong external force over a wide range thereon. Moreover, since the resilient contact tongue 18 engages with the restrictive portion 23*a* at the second area C2 in the plane contact manner, the external force is distributed on the second area C2, thereby positively avoiding the excess deflection.

Since the restrictive portion 23*a* is formed on the side wall 22 of the box-like body 13 by a bulging process, the side wall has no punched out portion in comparison with the conventional restrictive portion formed by a punching process. Consequently, the bulged restrictive portions 23*a* can reinforce the side walls 22 and prevent the box-like body 13 from being deformed.

The first embodiment described above can be altered as follows.

Figure 7A:
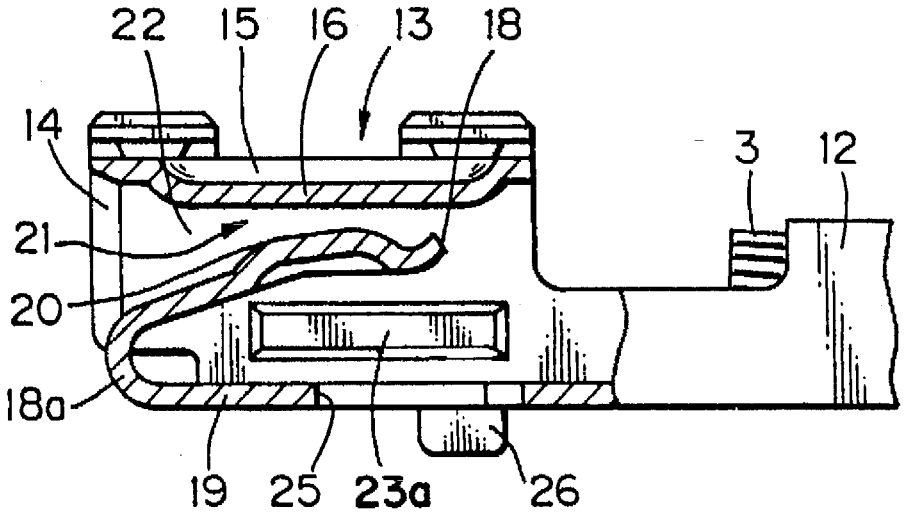
FIGS. 7A and 7B are longitudinal sectional views of alterations of the first embodiment.
Figure 7B:
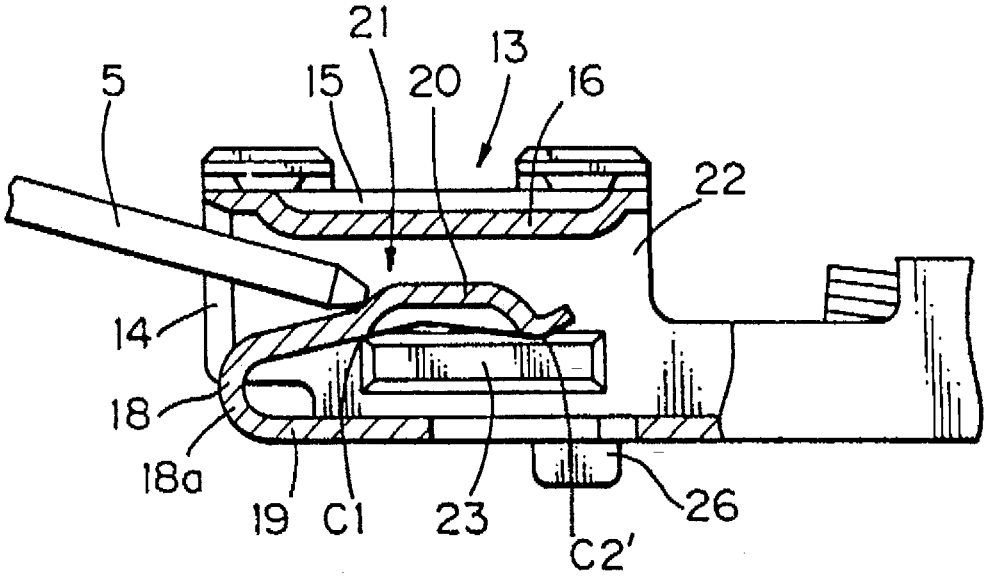

Although the free end of the resilient contact tongue 18 engages with the restrictive portion 23*a* over a certain distance in the above embodiment (FIG. 5), the free end may engage with the portion 23*a* in a linear contact manner. That is, the resilient contact tongue 18 may engage with the restrictive portion 23*a* at the front and rear contact areas C1 and C2' as shown in FIGS. 7A and 7B. In this case, it is also possible to prevent excess deflection of the resilient contact tongue 18 regardless of an abutting position of the mating tab 5 or a biting position of the foreign substance.

Figure 8:
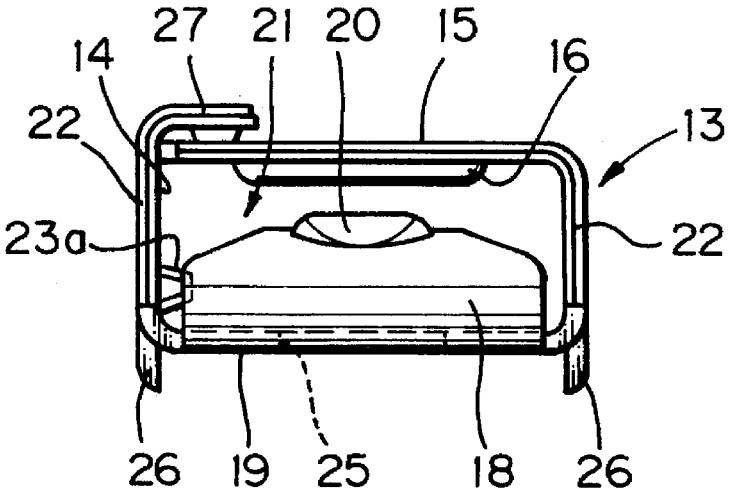
FIG. 8 is a front elevational view similar to FIG. 2, illustrating another alteration of the first embodiment.

Although the restrictive portion 23*a* is provided on each side wall 22 in the first embodiment (FIG. 2), the restrictive portion 23*a* may be provided on either side wall 22 so long as the restrictive portion 23*a* can bear the resilient contact tongue 18 at two front and rear areas in the longitudinal direction (FIG. 8).

Figure 9:
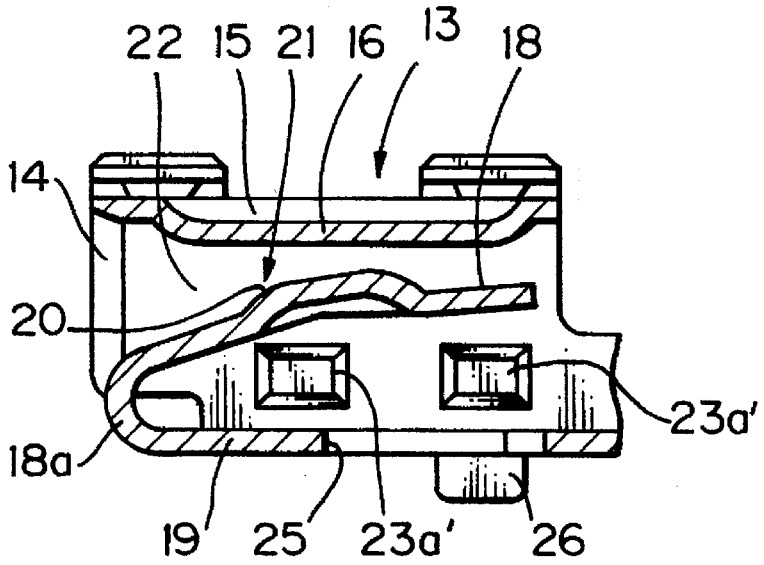
FIG. 9 is a longitudinal sectional view similar to FIG. 4, illustrating still another alteration of the first embodiment.

Although the restrictive portion 23*a* is formed into a united elongate bulged area in the first embodiment (FIG. 4), the restrictive portion 23*a*' may be divided into two front and rear bulged areas in the longitudinal direction of the resilient contact tongue 18, as shown in FIG. 9.

Next, a second embodiment of the female terminal metal fixture in accordance with the present invention will be explained below by referring now to FIGS. 10 to 16.

Figure 10:
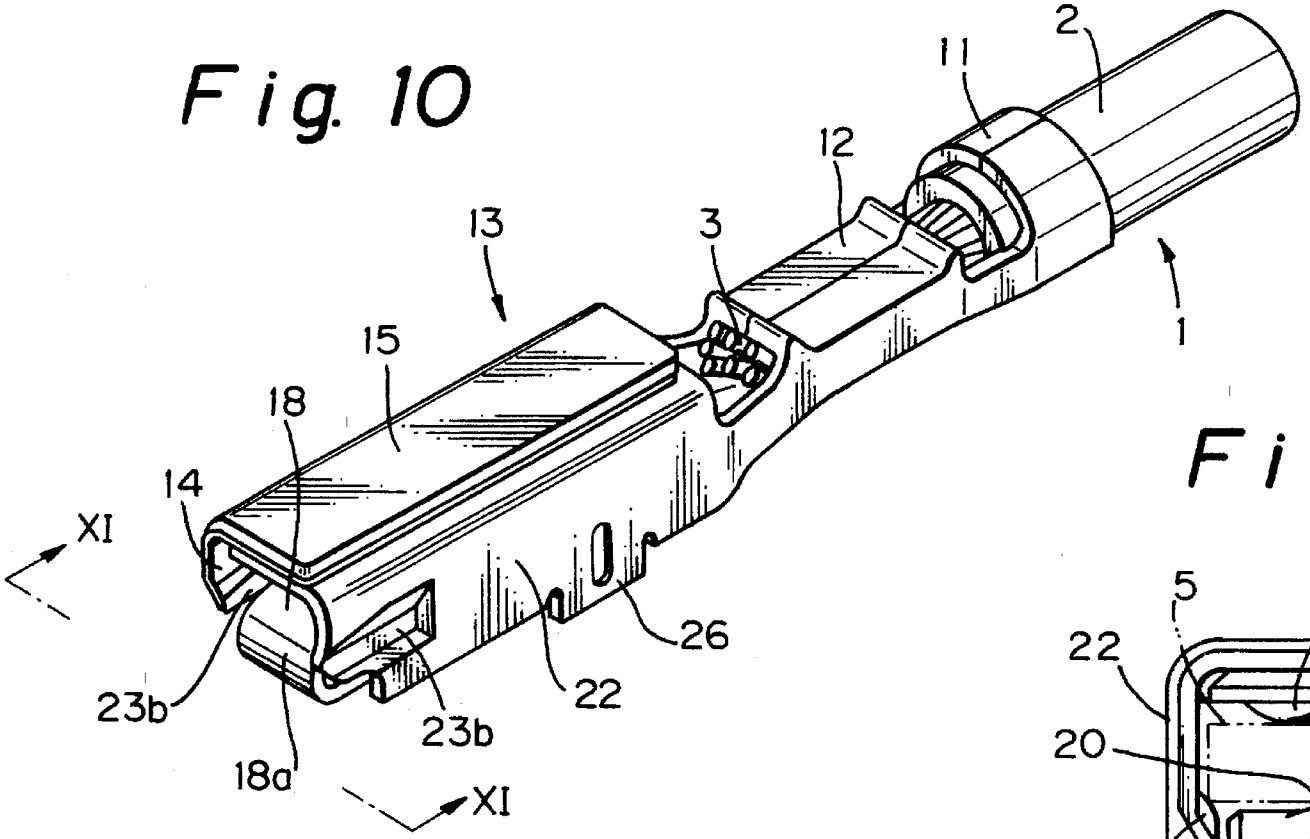
FIG. 10 is a perspective view of a second embodiment of a female terminal metal fixture of the present invention.

The female terminal metal fixture in this embodiment is formed by bending a thin metallic plate. As shown in FIG. 10, the female terminal metal fixture includes an insulation barrel 11 which is adapted to clamp an end of an insulation cover 2 of an electrical cable 1, a wire barrel 12 which is adapted to clamp an exposed end of core wires 3, and a box-like body 13 which extends from a front end of the wire barrel 12.

The box-like body 13 is provided in its front end with a front opening 14 and on its upper portion with a ceiling wall 15 which is formed by folding side ends of the thin metallic plate and putting one upon another. The ceiling wall 15 is provided with two inwardly bulged contact areas 16 extending in a longitudinal direction of the fixture.

The box-like body 13 is provided in its interior with a resilient contact tongue 18 adapted to contact with a tab of a mating male terminal metal fixture. The resilient contact tongue 18 is formed by bending inwardly in a U-shape an elongate plate extending from a front end of a bottom wall 19 in a developed state of the female metal fixture. The resilient contact tongue 18 ascends toward the inner part in the box-like body 13 in the natural state. The resilient contact tongue 18 is provided on its front end, middle portion and rear ends with a turn-back portion 18*a*, an upwardly bulged contact surface 20 and a curved portion 29, respectively. The curved portion 29 is formed into a hair pin-like shape by bending a free end of the resilient contact tongue 18 toward the bottom wall 19. The curved portion 29 is separated from the bottom wall 19 when the resilient contact tongue 18 is in a natural state. The curved portion 29 elastically contacts with the bottom wall 19 when the tab 5 with a standard thickness is inserted into the female terminal metal fixture.

The resilient contact tongue 18 is provided near the curved portion 29 with the upwardly bulged contact surface 20 mentioned above. An insertion space 21 adapted to receive the tab 5 of the male terminal metal fixture is defined between the resilient contact tongue 18 and the ceiling wall 15 of the box-like body 13.

Figure 11:
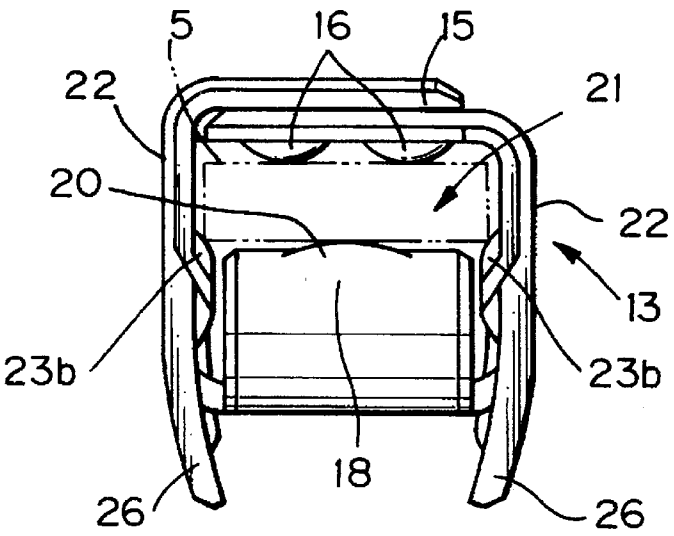
FIG. 11 is a front elevational view of the second embodiment taken along line XI—XI in FIG. 10.
Figure 12:
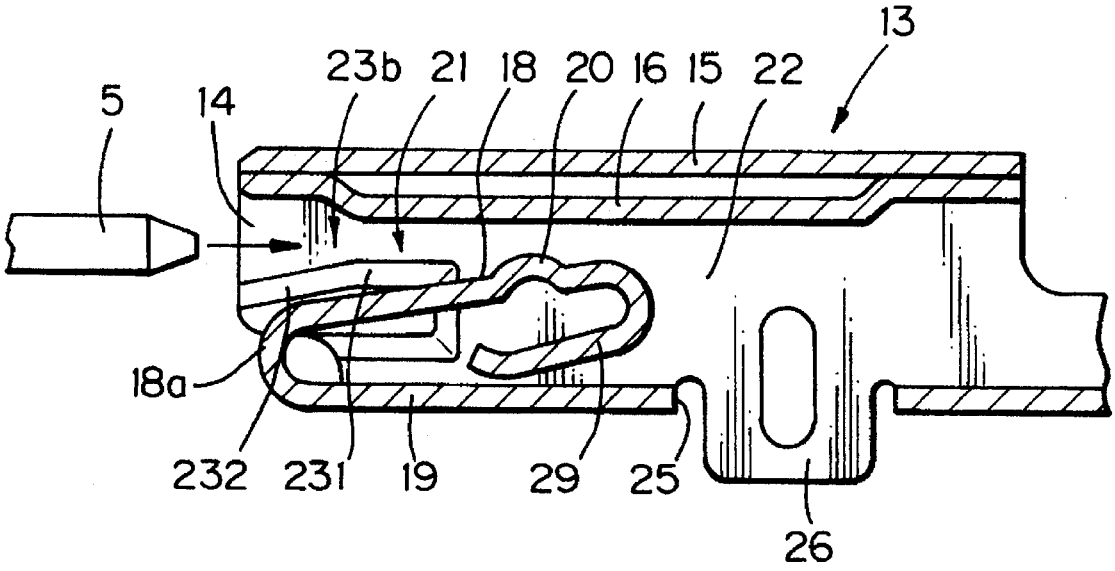
FIG. 12 is a longitudinal sectional view of the second embodiment shown in FIG. 10.

The box-like body 13 is provided on each side wall 22 with a restrictive portion 23*b* which restricts entrance of a foreign substance. The restrictive portion 23*b* is formed by bulging inwardly the side wall 22 and provided with a peripheral edge except a portion adjacent the front opening 14. The peripheral edge has an even width and an inwardly slanting face. The center part of the restrictive portion 23*b* enclosed by the peripheral edge is formed into a flat face. The restrictive portion 23*b* extends from the front opening 14 to a middle portion of the resilient contact tongue 18. Moreover, as shown in FIG. 11, a distance between inner flat faces of the restrictive portions 23*b* is set to be slightly smaller than a lateral width of the tab 5 of the male terminal metal fixture (shown by two-dot chain lines in FIG. 11).

Figure 13:
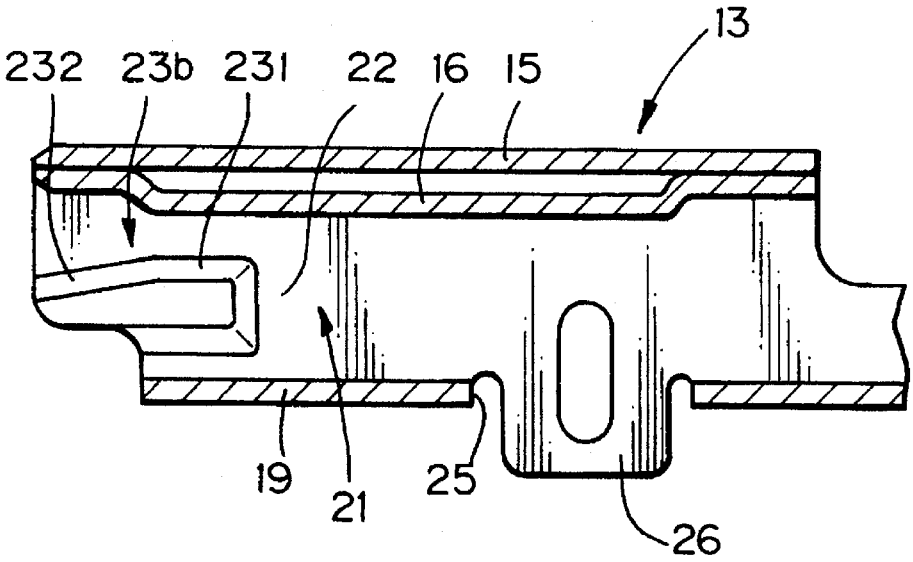
FIG. 13 is a longitudinal sectional view similar to FIG. 12 but removing a resilient contact tongue to show restrictive portion in detail.
Figure 15:
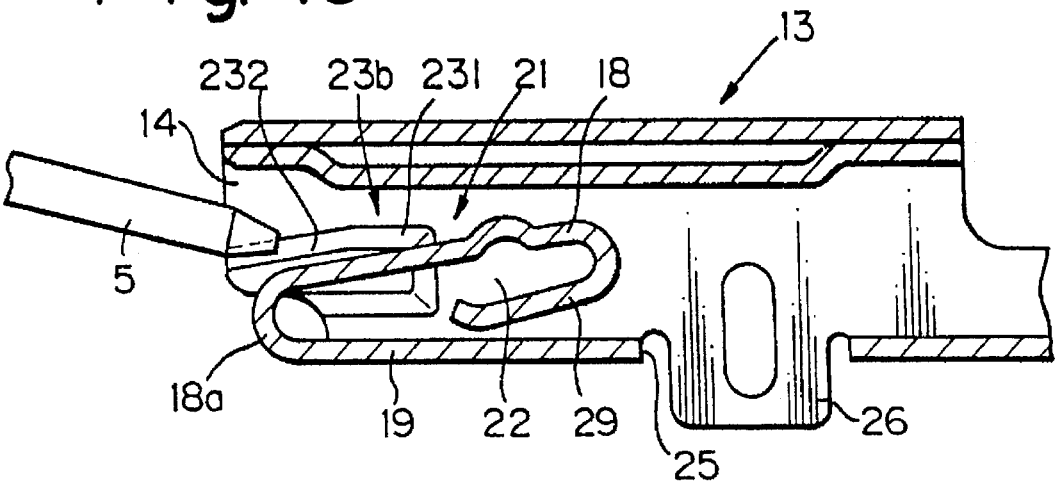
FIG. 15 is a longitudinal sectional view similar to FIG. 12, illustrating an initial position in which the tab is incorrectly inserted into the box-like body.

As shown in FIG. 13, the upper edge of the respective portion 23*b* has a horizontal edge section 231 parallel to the ceiling wall 15 at an inner half part. A distance from the inwardly bulged contact surface 16 on the ceiling wall 15 to the center of the slant face on the horizontal edge section 231 is set to be substantially the same as a standard thickness of the tab 5. The other upper edge of the respective portion 23*b* is an ascent slope edge section 232 extending from the front opening 14 to the horizontal edge section 231. As shown in FIG. 15, the ascent slope edge section 232 can correct an insertion angle of the tab 5, even if the tab 5 enters into the front opening 14 in a slant manner. In this embodiment, the ascent slope edge section 232 and horizontal edge section 231 on the restrictive portion 23*b* are disposed above a top face of the turn-back portion 18*a* of the resilient contact tongue 18 in the natural state.

The bottom wall 19 of the box-like body 13 is provided with an opening 25 at an inner part beyond the curved portion 29 of the resilient contact tongue 18. The opening 25 receives a lance in a female connector housing (not shown) in which accommodates the female terminal metal fixture, thereby preventing the fixture from coming out of the housing. A stabilizer 26 stands on each side edge of the opening 25 in order to stabilize a posture of the female terminal metal fixture in the female connector housing.

An operation of the second embodiment of the present invention will be described below.

Figure 14:
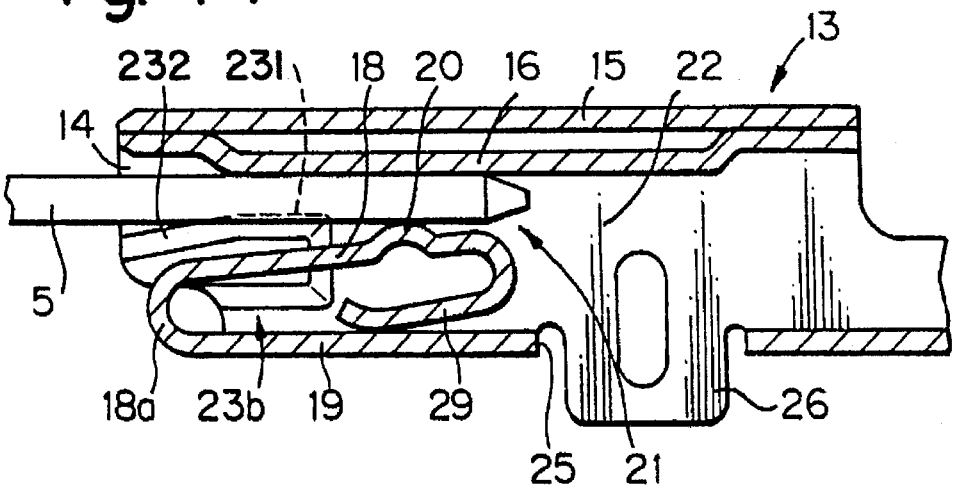
FIG. 14 is a longitudinal sectional view similar to FIG. 12, illustrating a position in which a tab is correctly inserted into a box-like body.

In the case that the tab 5 of the male terminal metal fixture has a standard thickness and is inserted through the front opening 14 in the box-like body 13 into the insertion space 21 in a correct posture parallel to the ceiling wall 15, the tab 5 slides on the horizontal edge sections 231 on the restrictive portion **23*b*. Then, the tab 5 abuts on the upwardly bulged contact surface 20 and pushes down the resilient contact tongue 18 gradually while moving on the surface 20. As shown in FIG. 14, the resilient contact tongue 18 is gradually deflected down about the turn-back portion 18*a* within an elastic limit while the curved portion 29 contacts with the bottom wall 19. When the tab 5 is elastically clamped between the inwardly bulged contact surfaces 16 on the ceiling 15 and the upwardly bulged contact surface 20 on the resilient contact tongue 18, the tab 5 is electrically coupled to the tongue 18**.

In the case that any dust such as metal dust and the like attach to the tab 5, a thickness of the tab 5 is greater than a regular thickness by a thickness of a dust layer. Consequently, the tab 5 cannot pass over the restrictive portions **23*b* and cannot reach the insertion space 21 (FIG. 15), because the thickness of the tab 5 becomes larger than a distance from the horizontal edge section 231 on the restrictive portion 23*b* to the inwardly bulged contact surface 16. Thus, the resilient contact tongue 18 is not deformed by the tab 5**.

Thus, the resilient contact tongue 18 is protected from a being excessively deflected, since a tab having a greater thickness than a regular thickness is impeded beforehand from entering into the insertion space 21. Even if the tab thickness becomes larger than a standard thickness on account of production errors, the same effect can be achieved.

Figure 16:
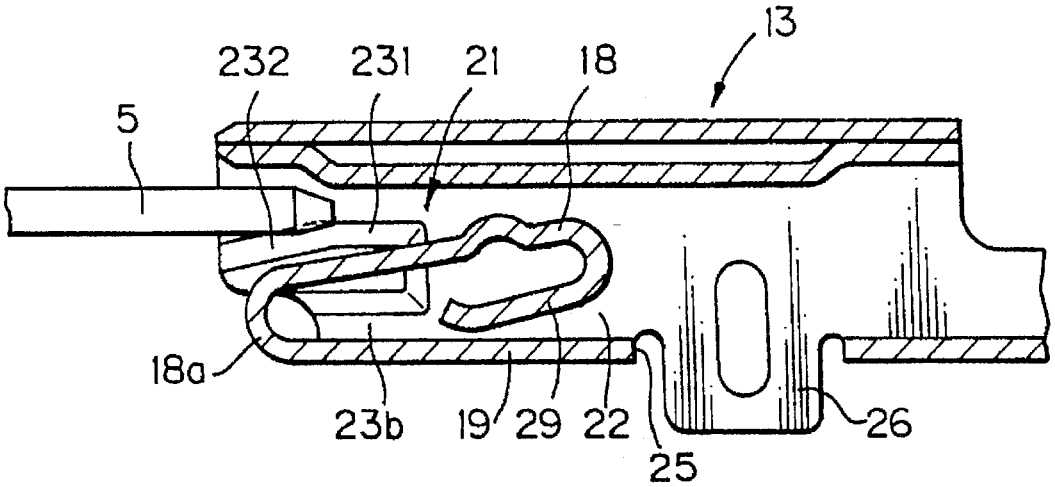
FIG. 16 is a longitudinal sectional view similar to FIG. 15, illustrating a half way position in which the tab is being guided into an insertion space in the box-like body.

Moreover, in the case that the tab 5 is inserted into the front opening 14 in a slant down posture due to an alignment error as shown in FIG. 15, the tab 5 abuts on the ascent slope edge section 232 on the restrictive portions **23*b* thereby limiting advance of the tab to the tongue 18. When the tab 5 continues moving to the insertion space 21, the tab 5 is gradually directed upwardly while sliding on the ascent edge section 232 on the restrictive portion 23*b* and then the posture of the tab 5 is corrected to a horizontal direction step by step as shown in FIG. 16. When the tab 5 is moving on the horizontal edge section 231 on the restrictive portion 23*b*, the tab 5 is directed to the regular posture and guided to the insertion space 21. Then, the tab 5 deflects down the resilient contact tongue 18 by a given distance within its elastic limit, so that the tab 5 is connected to the resilient contact tongue 18 as shown in FIG. 14**.

According to the second embodiment of the present invention, it is possible to surely prevent the resilient contact tongue 18 from being extremely deflected over its elastic limit when any unnecessary pushing force is applied on the tongue 18, since the tab 5 over a standard thickness (including any foreign substance over the standard thickness) is impeded from entering into the insertion space 21. Consequently, the resilient contact tongue 18 can maintain a given spring constant and a good electrical communication with the tab 5.

Moreover, even if the tab 5 is obliquely inserted into the front opening 14 in the box-like body 13, the restrictive portion **23*b* protects the resilient contact tongue 18 in the same manner described above. In particular, in the second embodiment, since the tab 5 is naturally directed to the correct insertion posture along the ascent slope edge section 232 on the restrictive portion 23*b* and guided into the insertion space 21, it is possible to smoothly insert the tab 5 into the insertion space 21**.

In the case that the thickness of the tab 5 is over an allowance error, such tab abuts on an inlet port of the horizontal edge section 231 on the restrictive portion **23*b* and cannot advance further. Accordingly, the resilient contact tongue 18** is prevented from being excessively deflected and, at the same time, it is possible to detect a defective tab.

The second embodiment described above can be modified as follows.

Figure 17:
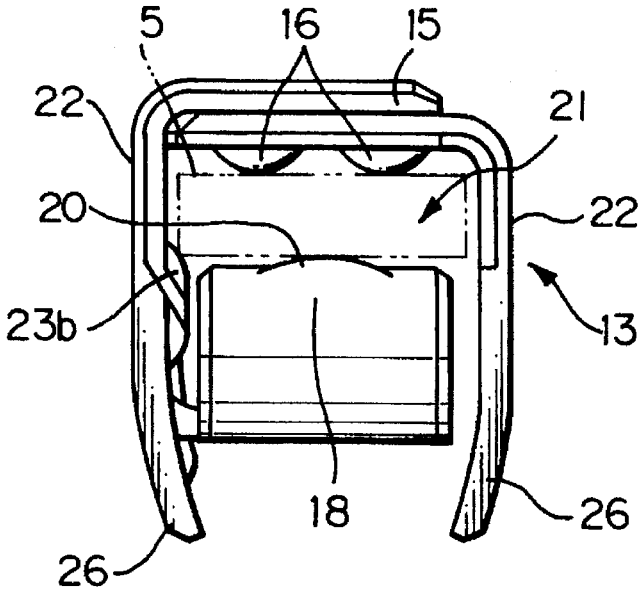
FIG. 17 is a front elevational view similar to FIG. 11, illustrating another alteration of the second embodiment.

Although the restrictive portion **23*b* is provided on each side wall 22 in the first embodiment (FIG. 11), the restrictive portion 23*b* may be provided on either side wall 22 as shown in FIG. 17, so long as the restrictive portion 23*b* can limit a downward movement of the tab 5**.

Figure 18:
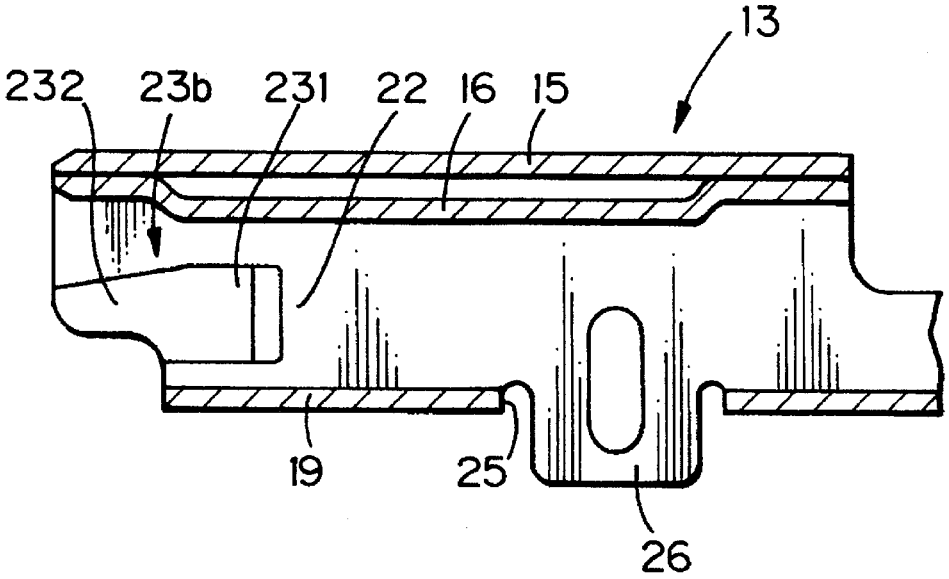
FIG. 18 is a longitudinal sectional view similar to FIG. 13, illustrating still another alteration of the second embodiment.
Figure 19:
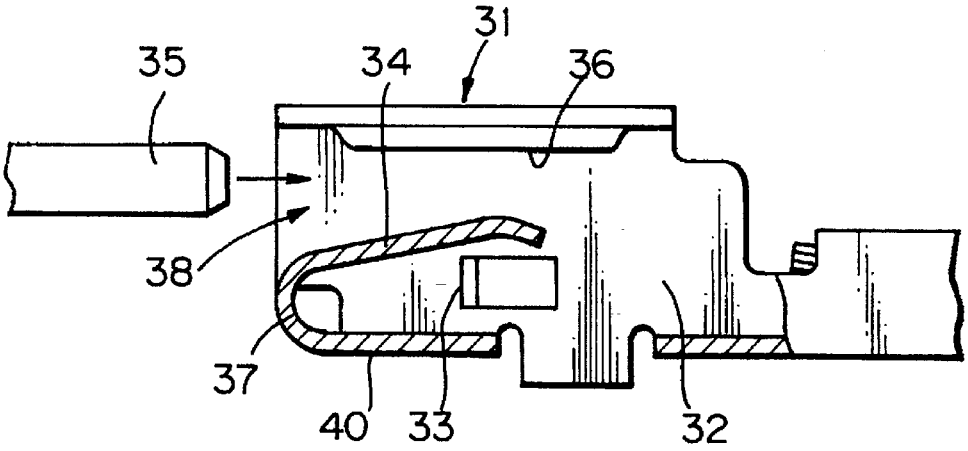
Fig. 19 PRIOR ART
FIG. 19 is a longitudinal sectional view of a conventional female terminal metal fixture.
Figure 20:
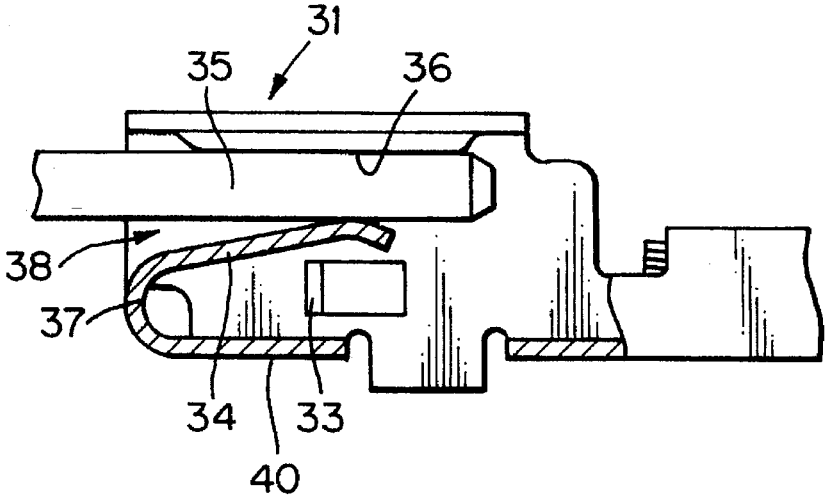
Fig. 20 PRIOR ART
FIG. 20 is a longitudinal sectional view similar to FIG. 19, illustrating a position in which a tab is correctly inserted into a box-like body.
Figure 21:
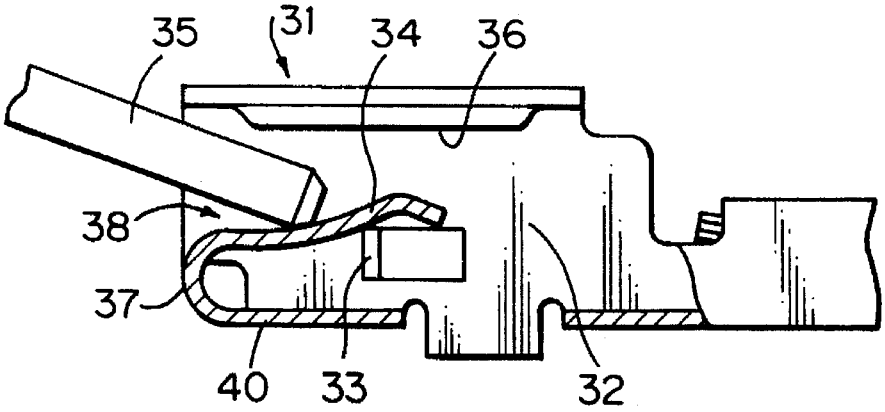
Fig. 21 PRIOR ART
FIG. 21 is a longitudinal sectional view similar to FIG. 19, illustrating a position in which the tab is incorrectly by inserted into the box-like body.
Figure 22:
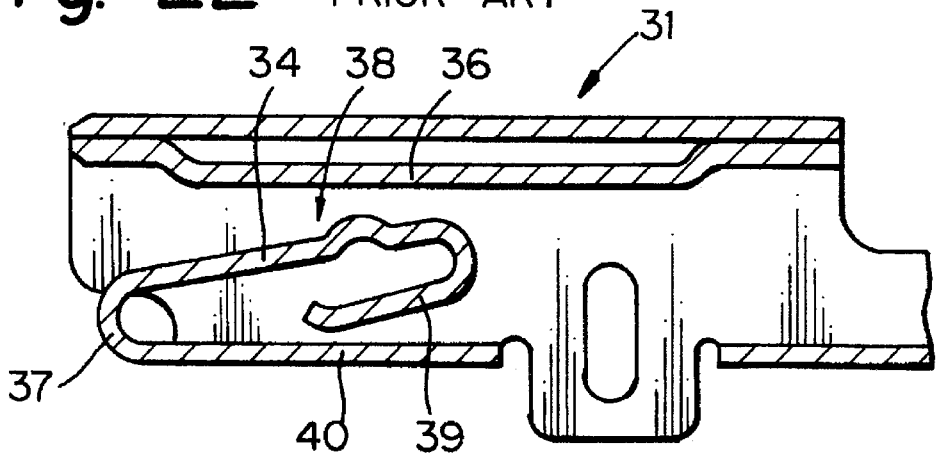
Fig. 22 PRIOR ART
FIG. 22 is a longitudinal sectional view of another conventional female terminal metal fixture.
Figure 23:
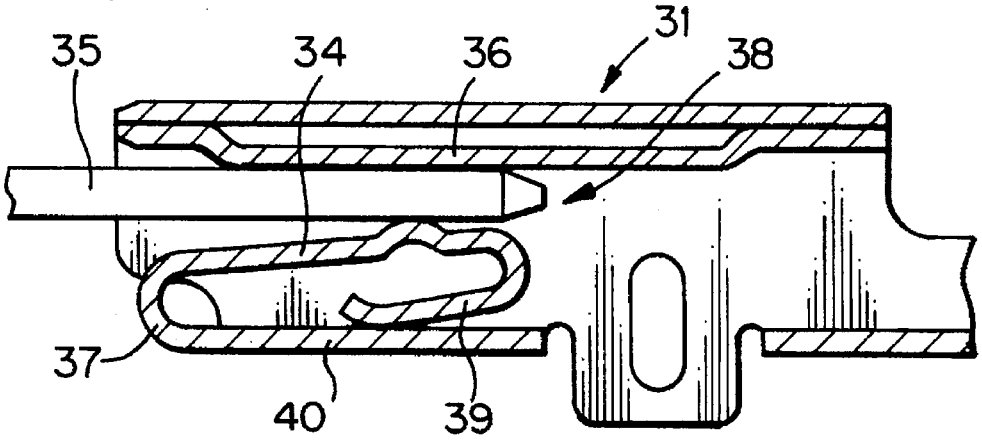
Fig. 23 PRIOR ART
FIG. 23 is a longitudinal sectional view similar to FIG. 22, illustrating a position in which a tab is correctly inserted into a box-like body.
Figure 24:
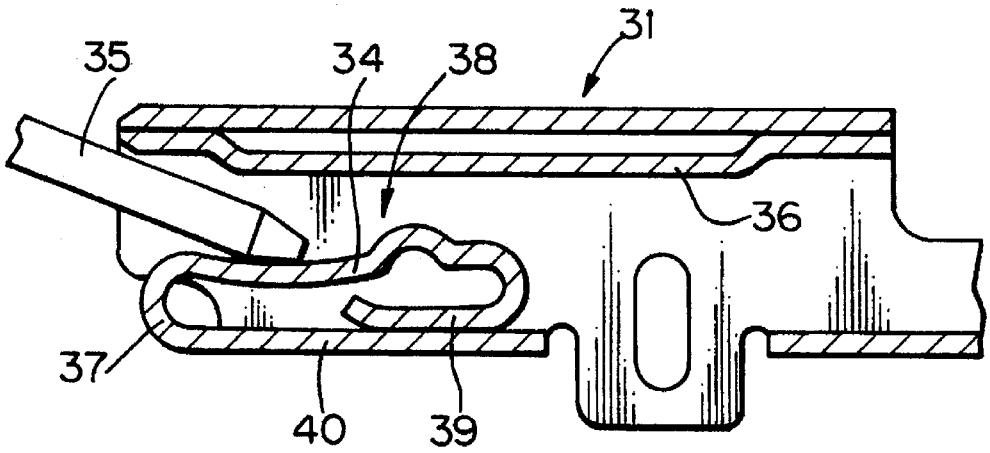
Fig. 24 PRIOR ART
FIG. 24 is a longitudinal sectional view similar to FIG. 22, illustrating a position in which the tab is incorrectly inserted into a box-like body.

The restrictive portion **23*b* may be formed by punching up the side wall 22 of the box-like body 13 (FIG. 18) as well as by bulging the side wall 22**.

What is claimed is:

1. A female terminal metal fixture comprising a box-like body, a resilient contact tongue bent back into an interior of said body from a front end of said body, an insertion space defined by said tongue and walls of said body, said space adapted to resiliently receive and make electrical contact with a tab of a male terminal metal fixture, an inwardly bulged restrictive portion on at least one side wall of said body, said resilient contact tongue, when said tab is in said space, in contact with said restrictive portion at its distal end over a given length.

2. A female terminal metal fixture according to claim 1, wherein said restrictive portion is provided on either side wall of said box-like body.

3. A female terminal metal fixture according to claim 1, wherein said restrictive portion is bulged inwardly from each side wall of said box-like body so that said restrictive portion prevents said tab of said male terminal fixture from approaching said resilient contact tongue over an allowable range.

4. The female terminal metal fixture of claim 1 wherein there are two restrictive portions, one on each side wall of said body.

5. A female terminal metal fixture according to claim 1, wherein said restrictive portion is formed discontinuously at two positions in the longitudinal direction in said insertion space in said box-like body.

6. A female terminal metal fixture according to claim 5, wherein said resilient contact tongue contacts with said restrictive portion at the distal end over a given length.

7. A female terminal metal fixture according to claim 5, wherein said resilient contact tongue contacts with said restrictive portion at the distal end in a substantial linear manner.

8. A female terminal metal fixture according to claim 1, wherein said restrictive portion is formed continuously over a given length in the longitudinal direction in said insertion space in said box-like body.

9. A female terminal metal fixture according to claim 8, wherein said resilient contact tongue contacts with said restrictive portion at the distal end in a substantial linear manner.

10. A female terminal metal fixture comprising a box-like body, a resilient contact tongue bent back into an interior of said body from a front end of said body, an insertion space defined by said tongue and walls of said body, said space adapted to resiliently receive and make electrical contact with a tab of a male terminal metal fixture, an inwardly bulged restrictive portion on at least one side wall of said body, said restrictive portion near an inlet port in said body and having, on its distal end, an ascent slope section adapted to contact a loading end of said tab, thereby to guide said tab into said insertion space when said tab is introduced into said body obliquely.

11. A female terminal metal fixture according to claim 10, wherein said restrictive portion is provided on either side wall of said box-like body.

* * * * *